US007439432B2

(12) United States Patent
Hiraku

(10) Patent No.: US 7,439,432 B2
(45) Date of Patent: Oct. 21, 2008

(54) PAD FOR ELECTRONIC DRUM AND ELECTRONIC DRUM

(75) Inventor: Tatsuya Hiraku, Hamamatsu (JP)

(73) Assignee: Yamaha Corporation (JP)

( * ) Notice: Subject to any disclaimer, the term of this patent is extended or adjusted under 35 U.S.C. 154(b) by 158 days.

(21) Appl. No.: 11/072,598

(22) Filed: Mar. 4, 2005

(65) Prior Publication Data

US 2005/0211062 A1 Sep. 29, 2005

(30) Foreign Application Priority Data

Mar. 8, 2004 (JP) ..... 2004-063888

(51) Int. Cl.
*G10D 13/02* (2006.01)

(52) U.S. Cl. ..... 84/414; 84/411 P

(58) Field of Classification Search ..... 84/414
See application file for complete search history.

(56) References Cited

U.S. PATENT DOCUMENTS 3,946,897 A * 3/1976 Wolff ..... 220/782
4,308,782 A * 1/1982 Hartry ..... 84/414
4,362,081 A * 12/1982 Hartry ..... 84/414
4,679,479 A 7/1987 Koyamato
4,706,540 A * 11/1987 Donohoe ..... 84/414
4,947,725 A * 8/1990 Nomura ..... 84/723
5,042,356 A * 8/1991 Karch ..... 84/725
5,091,248 A * 2/1992 Belli ..... 442/149
5,385,076 A * 1/1995 Belli ..... 84/414
5,520,090 A * 5/1996 Eagle ..... 84/411 P
5,581,044 A * 12/1996 Belli et al. ..... 84/414
5,585,581 A * 12/1996 Rogers ..... 84/414
5,837,915 A 11/1998 Suenaga
5,854,436 A * 12/1998 Wernick ..... 84/411 P
5,932,823 A * 8/1999 Jacobs ..... 84/411 P
RE36,387 E * 11/1999 Rosenberg et al. ..... 702/139
6,175,068 B1 * 1/2001 Belli ..... 84/414
6,297,177 B1 * 10/2001 Belli et al. ..... 442/242
6,365,812 B1 * 4/2002 McGill ..... 84/414
6,500,563 B1 * 12/2002 Datta et al. ..... 428/521

(Continued)

FOREIGN PATENT DOCUMENTS

EP 732683 A2 * 9/1996

(Continued)

OTHER PUBLICATIONS

PET Film (biaxially oriented): citing use on drums since 1958 and Young's modulus of 4 GPa, http://en.wikipedia.org/wiki/PET_film_(biaxially_oriented), viewed Dec. 20, 2007.*

(Continued)

*Primary Examiner*—Lincoln Donovan
*Assistant Examiner*—Robert W Horn
(74) *Attorney, Agent, or Firm*—Rossi, Kimms & McDowell, LLP

(57) ABSTRACT

An electronic drum comprises a pad comprising a body portion made of a polymeric elastic material such as a rubber or a thermoplastic elastomer, and a surface layer portion which is bonded with the body portion so as to cover the body portion, the surface layer portion being made of a polymeric material having an elastic modulus of 0.5 to 20 GPa.

7 Claims, 1 Drawing Sheet

U.S. PATENT DOCUMENTS

| | | | | |
|---|---|---|---|---|
| 6,762,353 | B2 * | 7/2004 | Okumura | 84/411 R |
| 6,794,569 | B2 * | 9/2004 | Kamijima et al. | 84/746 |
| 6,822,148 | B2 * | 11/2004 | Yanase | 84/422.1 |
| 6,828,494 | B2 * | 12/2004 | Toda | 84/411 R |
| 6,921,857 | B2 * | 7/2005 | Yoshino et al. | 84/738 |
| 6,949,701 | B2 * | 9/2005 | Okumura | 84/411 R |
| 7,135,630 | B2 * | 11/2006 | Maruhashi et al. | 84/411 P |
| 2002/0081423 | A1 * | 6/2002 | Heffelfinger | 428/297.4 |
| 2002/0112593 | A1 * | 8/2002 | Yanase | 84/411 P |
| 2004/0149120 | A1 * | 8/2004 | Maruhashi et al. | 84/411 R |
| 2005/0109190 | A1 * | 5/2005 | Smith et al. | 84/414 |
| 2005/0211062 | A1 * | 9/2005 | Hiraku | 84/414 |
| 2006/0048630 | A1 * | 3/2006 | Suzuki | 84/411 R |

FOREIGN PATENT DOCUMENTS

| | | | | |
|---|---|---|---|---|
| JP | 61-251900 | A | | 11/1986 |
| JP | 06175651 | A | * | 6/1994 |
| JP | 8-44357 | A | | 2/1996 |
| JP | 9-244633 | A | | 9/1997 |
| JP | 09244633 | A | * | 9/1997 |
| JP | 9-244633 | A | | 11/1997 |
| JP | 9-311684 | A | | 12/1997 |
| JP | 11-212565 | A | | 8/1999 |
| JP | 2003-295864 | A | | 10/2003 |
| JP | 2003295864 | A | * | 10/2003 |
| JP | 2005227535 | A | * | 8/2005 |
| JP | 2005250340 | A | * | 9/2005 |
| JP | 2005274727 | A | * | 10/2005 |
| JP | 2006047832 | A | * | 2/2006 |

OTHER PUBLICATIONS

Elastic Modulus and Young Modulus for Some Material, The Engineering Tool Box © 2005, http://www.engineeringtoolbox.com/young-modulus-d_417.html, viewed Dec. 20, 2007.*

Notice of Reasons for Rejection issued in corresponding Japanese patent application No. 2004-063888, dated Mar. 18, 2008.

* cited by examiner

PAD FOR ELECTRONIC DRUM AND ELECTRONIC DRUM

BACKGROUND OF THE INVENTION

1. Field of the Invention

The present invention relates to a pad for an electronic drum in which a musical sound is obtained as an electronic sound by electronically converting a striking sound, and an electronic drum having the same.

This application claims priority on Japanese Patent Application No. 2004-63888 filed on Mar. 8, 2004, the disclosure of which is incorporated herein by reference.

2. Description of the Related Art

This kind of electronic drum and pad for electronic drum serving as the striking face are described, for example, in Japanese Patent Application, First Publication No. Hei 9-244633 (corresponding to the U.S. Pat. No. 5,837,915).

Examples of characteristics required of the material of such a pad for an electronic drum include quietness of a striking sound generated when the pad is struck by a stick, sufficient structural durability to endure long-term striking and intense striking, chemical durability to withstand deterioration due to ultraviolet light, oxygen and moisture, and a striking feel which resembles that of an acoustic drum.

As the material of the pad, there have conventionally been used polymeric elastic materials which show elasticity at normal temperature, for example, rubbers such as natural rubbers and various synthetic rubbers, and olefinic and styrenic thermoplastic elastomers. When using materials having a moderate hardness, for example, natural rubbers and styrenic thermoplastic elastomers, striking feel is improved because of good resiliency. However, there arise problems such as damage due to striking, and deterioration due to ultraviolet light as well as moisture and oxygen in the air because of poor structural durability and chemical durability.

When using materials having low hardness, for example, rubbers containing a dienic double bond and thermoplastic elastomers containing plasticizers such as low molecular weight oil component, quietness is improved because of high impact absorption properties, however, there arise problems such as poor striking feel due to greasiness, damage due to striking and deterioration due to ultraviolet light as well as moisture and oxygen in the air.

Japanese Patent Application, First Publication No. Hei 9-311684 (corresponding to the U.S. Pat. No. 5,585,581) discloses a material of a pad 6, comprising a film and a gel containing a polymeric material as a main component wrapped within the film. This material is obtained by wrapping a fluid gel having the same resiliency as that of an acoustick drum with a non-adhesive film such as polyurethane film, and it is considered that a good striking feel and durability can be achieved concurrently. However, the non-adhesive film faces not only the striking face, but also a substrate. Therefore, it is necessary to further use a plate for solid or a retaining ring so as to mechanically retain this pad on the substrate, resulting in a complicated structure.

SUMMARY OF THE INVENTION

To solve the above problems of the prior art, the present invention has been made, and an object thereof is to provide a pad for an electronic drum concurrently having improved three characteristics of quietness, durability and good striking feel, and an electronic drum having the same.

To achieve this, a pad according to the present invention has a body portion made of a polymeric elastic material, and a surface layer portion which is bonded with the body portion so as to cover the body portion. The surface layer portion is made of a polymeric material having an elastic modulus of 0.5 to 20 GPa.

In a pad according to the present invention, the polymeric elastic material is preferably a rubber or a thermoplastic elastomer.

In a pad according to the present invention, the surface layer portion preferably has a thickness of 0.05 to 1 mm. The surface layer portion is preferably composed of one or more layers.

In a pad according to the present invention, the surface layer portion is preferably formed by fusion bonding or other bonding of a film, a sheet, a woven fabric or a knit fabric made of polymeric material, or application of a coating composition comprising the polymeric material, or double molding or insert molding using the polymeric material.

The electronic drum of the present invention makes use of any variation of the pad for electronic drum described above.

DESCRIPTION OF THE PREFERRED EMBODIMENTS

The present invention will now be described in more detail.

In an electronic drum (described hereinafter) shown in FIG. 2 of the present invention, a pad 6 comprises a body portion and a surface layer portion.

Figure 1:
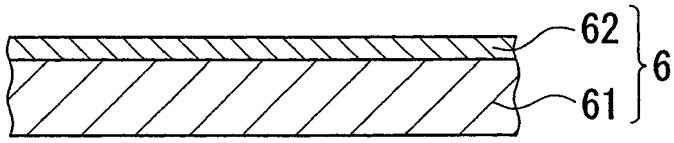
FIG. 1 is a schematic cross-sectional view showing an example of a pad according to an embodiment of the present invention.

FIG. 1 shows an example of the pad and the pad 6 comprises a body portion 61 and a surface layer portion 62.

The body portion 61 of the pad 6 is made of a polymeric elastic material which exhibits rubber elasticity, similarly to a conventional one. This polymeric elastic material is preferably a rubber or thermoplastic elastomer which has a hardness (Shore Durometer—A scale) within a range of 10 to 60. Suitable polymeric elastomers include natural rubbers; synthetic rubbers such as isoprene rubber, styrene-butadiene rubber, nitrile rubber, urethane rubber and silicone rubber; and thermoplastic elastomers such as olefinic thermoplastic elastomer, styrenic thermoplastic elastomer, urethane-based thermoplastic elastomer and vinyl chloride-based thermoplastic elastomer. There can also be used materials obtained by foaming the above materials, those obtained by sintering rubber particles or elastomer particles together, and those obtained by mixing two or more kinds of materials.

The thickness of the body portion 61 is from about 3 to 20 mm.

The surface layer portion 62 is made of a polymeric material having a tensile elasticity within a range of 0.5 to 20 GPa, preferably from 1 to 10 GPa, and is in the form of a flat film such as film, sheet, woven fabric, knit fabric or coating film. Examples of materials having an elastic modulus within a range from 0.5 to 20 GPa include thermoplastic resins such as aramid resin (aromatic polyamide resin, 10 to 20 GPa), polyethylene terephthalate (2 to 8 GPa), polypropylene (2 to 4 GPa), high-density polyethylene (0.6 to 1 GPa), polyurethane (0.5 to 3 GPa), polycarbonate (1 to 3 GPa), polyamide (Nylon®) (1 to 4 GPa), hard vinyl chloride resin (1 to 6 GPa) and cellulosic resin (1 to 4 GPa), and one or more kind of these materials used in combination.

The polymeric material constituting the surface layer portion 62 is not limited to a polymeric component alone and may be a composition comprising the polymeric component and various additives such as inorganic fillers. The above tensile elasticity is a value of the polymeric component alone of a value of the composition.

The thickness of the surface layer portion 62 is within a range of 0.05 to 1 mm. If the thickness is less than 0.05 mm, the surface layer portion 62 cannot function as such. On the other hand, if the thickness is more than 1 mm, the striking surface characteristics of the surface layer portion 62 are more pronounced than those of the body portion 61, resulting in inferior performance. The thickness of the surface layer portion 62 also has a relationship with the tensile elasticity of the polymeric material constituting the surface layer portion 62. The thickness may be decreased when using a material having a high elastic modulus, while the thickness is preferably increased when using a material having low elastic modulus. The thickness is preferably set within a range of 0.15 to 0.3 mm in the case of polypropylene having an elastic modulus of 2 GPa, while the thickness is preferably set to about 0.1 mm in the case of polyethylene terephthalate having an elastic modulus of 4 GPa.

In view of the relationship between the surface layer portion 62 and the body portion 61, the body portion 61 may be made of a foam, and the surface layer portion 62 may be made of a non-foam of the same material or may be made of a polymeric material having a composition a portion of which is the same as the composition of the polymeric elastic material constituting the body portion 61. This combination is preferable because adhesion between the two is improved. For example, the combination may be as follows: the body portion 61 is made of an olefinic thermoplastic elastomer and the surface layer portion 62 is made of polypropylene or high-density polyethylene.

Furthermore, one method of bonding the surface layer portion 62 to the body portion 61 includes a method of bonding a film, sheet, woven fabric or knit fabric made of the above polymeric material with the body portion 61 using an adhesive. Also there is available a method of thermally fusing a film, sheet, woven fabric or knit fabric made of the above polymeric material to the body portion 61 through heating. Also there is available an insert molding method of placing a film, sheet, woven fabric or knit fabric made of the above polymeric material in a mold and injection-molding a polymeric elastic material constituting the body portion 61 in the mold, or a double molding method of the polymeric material and the polymeric elastic material. Also there is available an insert molding method of previously forming a sheet-like body portion 61 made of a polymeric elastic material by means of extrusion molding or injection molding, placing the resulting body portion 61 in a mold and injection-molding a polymeric material constituting the surface layer portion 62 in the mold. Also there is exemplified a method of applying a coating composition comprising the above polymeric material to the surface of the body portion 61, followed by drying.

The surface layer portion 62 is not limited to a single-layered structure, and may have a multi-layered structure composed of two or more layers. In this case, the surface layer portion may be in various forms. For example, it may comprise a woven fabric or knit fabric as a layer close to the body portion 61 and a film, sheet or coating film formed thereon, or comprises a film or sheet as a layer close to the body portion 61 and a coating film formed thereon.

An electronic drum having the pad 6 described above will now be described.

Figure 2:
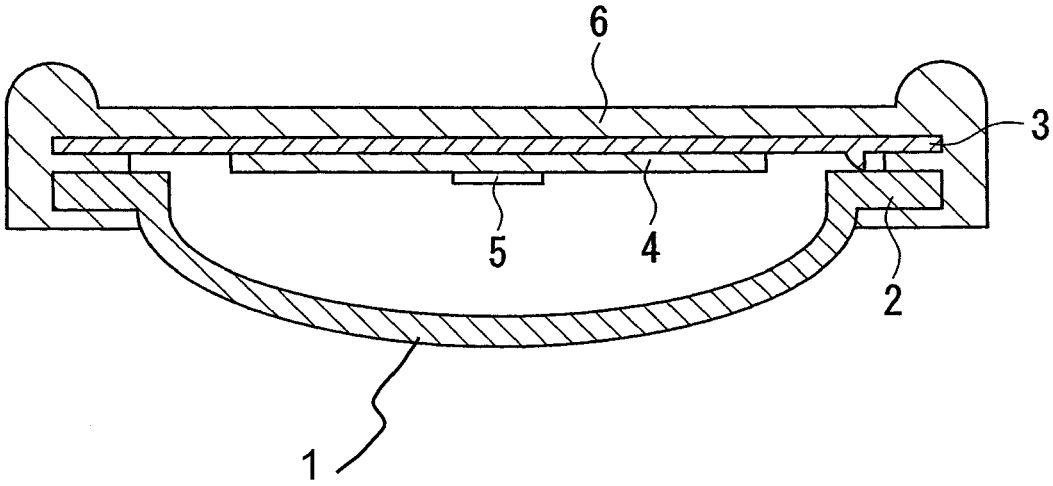
FIG. 2 is a schematic cross-sectional view showing an example of an electronic drum according to an embodiment of the present invention.

FIG. 2 shows an example of an electronic drum. In FIG. 2, the numeral 1 denotes a case. The case 1 is made of an impact-resistant synthetic resin such as ABS resin, or metal, and has a generally semispherical shape. A substrate 3 is attached to the outside periphery of the case 1 via a flange portion 2. This substrate 3 is made of a tabular steel plate or wood fiber plate, and its planar shape is circlar. An interior space is formed in the case 1 by attaching the substrate 3 to the case 1.

A buffer plate 4 is attached to the inner surface of the substrate 3. This buffer plate 4 has a sheet made of a foamed synthetic resin and a double-sided adhesive sheet formed on both surfaces of the sheet. One surface of the buffer plate 4 is attached to the inner surface of the substrate 3 and a sensor 5 is attached to the other surface of the buffer plate 4. The planar shape of the buffer plate 4 is a circle having a diameter smaller than that of the substrate 3, and the buffer plate is concentrically attached to the substrate 3.

The above-described pad 6 is fixed to the outer surface of the substrate 3. A portion of the substrate 3, the flange 2 and the case 1 is covered with this pad 6.

A drum head is composed of the substrate 3, the buffer plate 4, the sensor 5 and the pad 6, and an electronic drum is composed of the drum head and the case 1.

The outer surface of the pad 6 is the face struck by a drum stick and, when the striking face is struck by the drum stick, vibration of the pad 6 is transmitted to the sensor 5 via the substrate 3 and the buffer plate 4, and there converted into an electrical signal by the sensor 5. Then the electrical signal is amplified and subjected to electroacoustic transduction to produce a sound, or a previously predetermined electric sound is produced by a separately arranged electronic sound source based on the electrical signal.

Specific examples of the pad 6 for an electronic drum of the present invention will now be described in detail. The present invention is not limited to the following specific examples.

EXAMPLE 1

A pad 6 was produced by bonding a natural rubber (hardness: Shore A 60, thickness: 6 mm) as the body portion 61 with a polyethylene terephthalate film (thickness: 100 μm) as the surface layer portion 62 using an epoxy-based adhesive, and then an electronic drum having the structure shown in FIG. 1 was produced using the resulting pad 6.

In the resulting electronic drum comprising the pad 6, resiliency was improved, striking feel was improved, and furthermore a striking sound was satisfactorily dampened and good quietness was attained. Also it was made possible to minimize damage due to striking and deterioration of the body portion due to moisture and oxygen in an air.

EXAMPLE 2

A pad 6 was produced by applying a polyurethane coating composition to an olefinic thermoplastic elastomer (manufactured by JSR Co., Ltd., product number: Development TEL424, hardness: Shore A 20, thickness: 6 mm) serving as the body portion 61 to form a 60 μm thick coating film as the surface layer portion 62, and then an electronic drum was produced by using the resulting pad in the same manner as in Example 1.

In the resulting electronic drum comprising the pad 6, resiliency was improved and striking feel was improved and, furthermore, a striking sound was satisfactorily dampened and good quietness was attained. Also it was made possible to minimize damage due to striking and deterioration of the body portion due to moisture and oxygen in an air.

EXAMPLE 3

A pad 6 was produced by fixing a polypropylene film (thickness: 150 μm) as the surface layer portion 62 to an olefinic thermoplastic elastomer (manufactured by JSR Co., Ltd., product number: Development TEL424, hardness: Shore A 20, thickness: 6 mm) as the body portion 61 by means of an insert molding method, and then an electronic drum was produced by using the resulting pad in the same manner as in Example 1.

In the resulting electronic drum comprising the pad 6, resiliency was improved and striking feel was improved and, furthermore, a striking sound was satisfactorily dampened and good quietness was attained. Also it was made possible to minimize damage due to striking and deterioration of the body portion due to moisture and oxygen in an air.

EXAMPLE 4

An electronic drum comprising a pad 6 made of a natural rubber (hardness: Shore A 60, thickness: 6 mm) alone was produced.

The resulting electronic drum comprising the pad 6 was inferior in striking feel because of intrinsic greasiness of the natural rubber as the surface layer portion, and surface damage due to striking and surface cracking due to ultraviolet light as well as moisture and oxygen in an air occurred.

EXAMPLE 5

An electronic drum comprising a pad 6 made of an olefinic thermoplastic elastomer (hardness: Shore A 20, thickness: 6 mm) containing a low molecular weight oil was produced.

In the resulting electronic drum comprising the pad 6, the surface exhibits greasiness because of the oil added and, furthermore, resiliency was inferior because of low hardness, and striking feel was inferior.

TEST EXAMPLE

Resiliency of the pad produced in Example 3 was evaluated.

The evaluation procedure was as follows. Using a test sample obtained by bonding the pad with the surface of a 15 mm thick wood fiber plate (MDF) as the substrate using an epoxy-based adhesive, a steel ball (diameter: ⅝ inch, weight: 16.3 g) was dropped from a height of 300 mm onto the pad surface, and the rebouding height was visually measured. Ten measured values were averaged.

As a result, it was 196 mm in case of the pad produced in Example 3.

COMPARATIVE EXAMPLE

A pad made of an olefinic thermoplastic elastomer (manufactured by JSR Co., Ltd., product number: Development TEL424, hardness: Shore A 20, thickness: 6 mm) was produced and then bonded with a wood fiber plate (MDF) in the same manner as in the test example to obtain a test sample for comparison. Under the same conditions, the rebouding height of the steel ball was measured. Ten measured values were averaged.

As a result, it was 175 mm in case of this pad.

As is apparent from the results, by providing a surface layer portion made of polypropylene, resiliency is improved and striking feel is improved.

PLAY EVALUATION EXAMPLE

Five professional drum players were asked to play the electronic drum produced in Example 3 and to evaluate striking feeling during playing.

As a result, the electric drum was evaluated highly by all five players. That is, the same striking feel as that of an acoustic drum could be obtained even when the drum was played with high technical skill.

As described above, since the body portion of the pad for an electronic drum of the present invention was covered with the surface layer portion, the body portion is not directly exposed to the air and sunlight, and thus deterioration due to ultraviolet light, oxygen and moisture of the body portion can be prevented. Also since the surface layer portion is hard and has high rigidity, it is structurally resilient against striking by a stick, and thus damage such as scraping and cracking of the pad surface does not occur.

A polymeric material having a Young's modulus of 0.5 to 20 GPa is a material which generally has high rigidity and is free from stickiness. Therefore, when the surface layer portion is formed, the resulting pad is free from greasiness on the surface. Furthermore, resiliency is improved and striking feel is remarkably improved, and thus it is possible to sufficiently cope with high technical skill by a professional player.

Since the body portion is made of a polymeric elastic material such as rubber or thermoplastic elastomer, impact upon striking is absorbed rapidly and satisfactorily, and thus a striking sound damps and good quietness is attained.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as limited by the foregoing description but is only limited by the scope of the appended claims.

What is claimed is:

1. A pad for an electronic drum, comprising:

a body portion made of a polymeric elastic material, and a surface layer portion thermally fused to the body portion and covering the body portion, wherein the surface layer portion is made of polpropylene having an elastic modulus of 2-4 GPa and a thickness of the surface layer within a range of 0.15-0.3 mm, wherein the polymeric elastic material is a thermoplastic elastomer, and wherein the thickness of the body portion is greater than the thickness of the surface layer portion.

2. The pad for an electronic drum according to claim 1, wherein the surface layer portion is composed of one or more layers.

3. The pad for an electronic drum according to claim 1, wherein the surface layer portion is a film.

4. The pad for an electronic drum according to claim 1, wherein the polymeric elastic material contains an additive.

5. An electronic drum comprising the pad for an electronic drum of claim 1.

6. The pad for an electronic drum according to claim 4, wherein the additive is an inorganic filler.

7. The pad for an electronic drum according to claim 1, wherein the polymeric elastic material is made of olefinic thermoplastic elastomer.

* * * * *